US012246911B2

(12) United States Patent
James

(10) Patent No.: US 12,246,911 B2
(45) Date of Patent: Mar. 11, 2025

(54) TRANSPORT CONTAINER

(71) Applicant: Christopher Colin James, Johannesburg (ZA)

(72) Inventor: Christopher Colin James, Johannesburg (ZA)

( * ) Notice: Subject to any disclaimer, the term of this patent is extended or adjusted under 35 U.S.C. 154(b) by 791 days.

(21) Appl. No.: 17/286,363

(22) PCT Filed: Oct. 17, 2019

(86) PCT No.: PCT/IB2019/058878
§ 371 (c)(1),
(2) Date: Apr. 16, 2021

(87) PCT Pub. No.: WO2020/079648
PCT Pub. Date: Apr. 23, 2020

(65) Prior Publication Data

US 2021/0347561 A1 Nov. 11, 2021

(30) Foreign Application Priority Data

Oct. 17, 2018 (ZA) ..... 2018/06915

(51) Int. Cl.

| | |
|---|---|
| ***B65D 19/18*** | (2006.01) |
| ***B65D 88/12*** | (2006.01) |
| ***B65D 88/52*** | (2006.01) |
| ***B65D 90/00*** | (2006.01) |

(52) U.S. Cl.
CPC ..... *B65D 88/123* (2013.01); *B65D 88/522* (2013.01); *B65D 90/0033* (2013.01)

(58) Field of Classification Search
CPC .... B65D 88/123; B65D 88/522; B65D 88/52; B65D 90/0033; B65D 19/12; B65D 2519/009; B65D 2519/0087; B65D 2519/00875
USPC ..... 220/1.5, 6, 666; 206/600; 222/185.1; 294/68.21
See application file for complete search history.

(56) References Cited

U.S. PATENT DOCUMENTS

| | | | | | |
|---|---|---|---|---|---|
| 1,883,501 | A * | 10/1932 | Young | C23G 3/00 294/68.21 |
| 5,441,321 | A * | 8/1995 | Karpisek | B65D 90/623 294/68.21 |
| 8,376,168 | B2 * | 2/2013 | Fielden | B65D 19/06 206/508 |

(Continued)

FOREIGN PATENT DOCUMENTS

| | | | | |
|---|---|---|---|---|
| WO | WO 9304953 A1 | | 3/1993 | |
| WO | WO0030946 | * | 6/2000 | B65D 19/12 |
| WO | WO 0030946 A1 | | 6/2000 | |

*Primary Examiner* — Don M Anderson
*Assistant Examiner* — Elizabeth J Volz
(74) *Attorney, Agent, or Firm* — MUNCY, GEISSLER, OLDS & LOWE, P.C.

(57) ABSTRACT

A transport container for bulk cargo/materials has a rectangular base and four sidewalls. The sidewalls are hingedly connected to the base and movable from an erect condition, providing a box structure for loading of the container, into a folded flat condition for stacking of the container. The base includes hinged floor for discharge of the particulate material contents by lifting the container with forklift engaging formations at an upper end of two oppositely arranged sidewalls. Forklift sleeves on an underside of the floor allow for movement of the loaded container.

13 Claims, 4 Drawing Sheets

(56) References Cited

U.S. PATENT DOCUMENTS

2014/0083554 A1* 3/2014 Harris ..... B65D 88/54
141/1

* cited by examiner

TRANSPORT CONTAINER

FIELD OF THE INVENTION

The invention relates to a container for transport of bulk cargo, which is usually in the form of particulate material. The container is suited for use on a flatbed loading surface of a truck, trailer or rail wagon, tautliner (or curtain-side) truck or trailer, as well as on a loading surface provided on river/sea freight vessels.

BACKGROUND TO THE INVENTION

The particulate material referred to as bulk cargo is commonly mined coal or ores, such as chrome, manganese, iron ore, copper and or any building materials used for civils or construction. It may also be bulk material of agricultural or alternative loads, such as grain, wheat, fertilizer, sorghum, rice, bone meal, soda ash and so on.

In the case of these bulk materials, there is commonly a need for transport of loads from inland locations, where the loads originate and are processed, to harbours or ports for shipping as export products. The trucks that are used for transporting these loads are generally not suited to transport (conventional, enclosed) shipping containers from the harbours or ports back inland. As a result, it is not uncommon for trucks to make the inland trip empty. While bulk cargo also sometimes needs to be moved inland for consumption, the loads that are sent to the ports do not always match the required loads that need to be transported inland. There may however, for whatever reason, also be an imbalance in the opposite direction and the same problems arise.

The assembly of temporary structures on flatbed trucks and trailers to contain these particulate material loads has been proposed. The structures are thereafter removed to provide flatbed capacity for a shipping container on the return trip inland.

The proposals of the prior art are not considered optimal. There are some difficulties or inconveniences associated with loading and unloading these assembled structures with particulate material. Also, the required assembly onto a flatbed and disassembly of the structures is inconvenient, labour intensive and/or time consuming.

OBJECT OF THE INVENTION

It is an object of the invention to provide a container that facilitates transport of particulate material as bulk cargo and/or avoids the difficulties or inconveniences of the prior art.

SUMMARY OF THE INVENTION

In accordance with the invention there is provided a transport container for bulk cargo comprising a rectangular base and four sidewalls hingedly connected to the base with the sidewalls movable from an erect condition, providing a box structure for loading of the container, into a folded condition for stacking of the container.

It is a further feature of the invention that the box structure of the container provides an open loading space between the four sidewalls (absent any partition and/or re-enforcing structures).

The invention further provides for the base to include a floor comprising at least one discharge panel hingedly connected to the base; and for the floor to be provided as a hinged panel that extends across the base.

Further features of the invention provide for the base to include a rigid rectangular metal frame secured to the sidewalls through wall hinge components provided on an inner side of four connected frame members; and for the floor is located below the rectangular frame with floor hinge components provided on an outer side of one of four frame members.

A further feature of the invention provides for the frame of the base to be substantially square.

Further features of the invention provide for the sidewalls to be provided as two opposite pairs, with sidewalls of an inner pair having side edges located between sidewalls of the outer pair when the container is in the erect condition (and when the inner pair are moved towards and into a folded position); and for the sidewalls of the inner pair to be located below the sidewalls of outer pair when the container is in the folded, flat condition.

A further feature of the invention provides for the sidewalls of the inner pair have hinge connections to the frame structure that are spaced below hinge connections for the sidewalls of the outer pair on the rectangular frame.

Further features of the invention provide for the sidewalls of the inner pair to fold flat into a substantially co-planar condition and to be sized so that free ends are in juxtaposition; and for the sidewalls of the outer pair to fold flat into a substantially co-planar condition above the sidewalls of the inner pair (and to be sized so that free ends are in spaced apart relationship).

Further features of the invention provide for the sidewalls to locate against stops, when in an erect position, provided on the base; and for the stops to be provided by shoulders on the rectangular frame spaced above the wall hinge components; for sidewalls of the outer pair to have detents that hold sidewalls of the inner pair in an erect position; and for the detents to be provided as hinged lugs at free ends and adjacent the side edges of the sidewalls of the outer pair.

The invention further provides for the container to have forklift engaging formations at an upper end of two oppositely arranged sidewalls; for the forklift engaging formation to be provided on the sidewalls of the outer pair; and for first forklift engaging formations of one outer sidewall to extend from an inner side and second forklift engaging formations of the other outer sidewall to extend from an outer side, the arrangement of the first and second forklift engaging formations providing an overlapping arrangement when in a folded position.

The invention further provides for the floor to have a pair of forklift sleeves; for the forklift sleeves to be provided by two spaced apart channels secured against an underside of the floor; alternatively for the forklift sleeves to be provided by inverted channels secured with a web against an underside of each panel.

Further features of the invention provide for the sidewalls to be constructed from a metal wall frame supporting wooden planks (arranged upright); for adjacent planks to have a tongue and groove engaging formations; for the floor to be provided by a suitably thick sheet of metal re-enforced by the forklift sleeves; and for the floor to include (at least two, spaced apart) cross-supports providing gussets on either side of the forklift sleeves.

The invention further alternatively provides for the base to include two hingedly secured panels providing a floor with each panel having a pair of aligned forklift sleeves.

Further features of the invention provide for the bulk cargo to be particulate material; and, more specifically, a mining industry product.

The invention further provides for a set of transport containers for use secured along a flatbed loading surface of a truck, trailer and/or rail wagon, the containers having a width suited for use with one container across the flatbed loading surface and a length suited for use with a plurality of containers along the flatbed truck or trailer. The invention still further provides for the transport containers to be for use secured along a tautliner truck or trailer. The invention yet further provides for the transport containers to be for use on river/sea freight vessels.

The terms "below" and "above" are used as prepositions to indicate a position relative to the base and the configuration of the container which has an open top at one end and a floor at the other end, with the sidewalls in between. The term "underside", "top" and "bottom" should also be understood in this context.

BRIEF DESCRIPTION OF THE DRAWINGS

These and other features will become more apparent from the following description of the invention, made by way of example only, with reference to the accompanying drawings, in which.

DETAILED DESCRIPTION OF THE INVENTION

Figure 1:
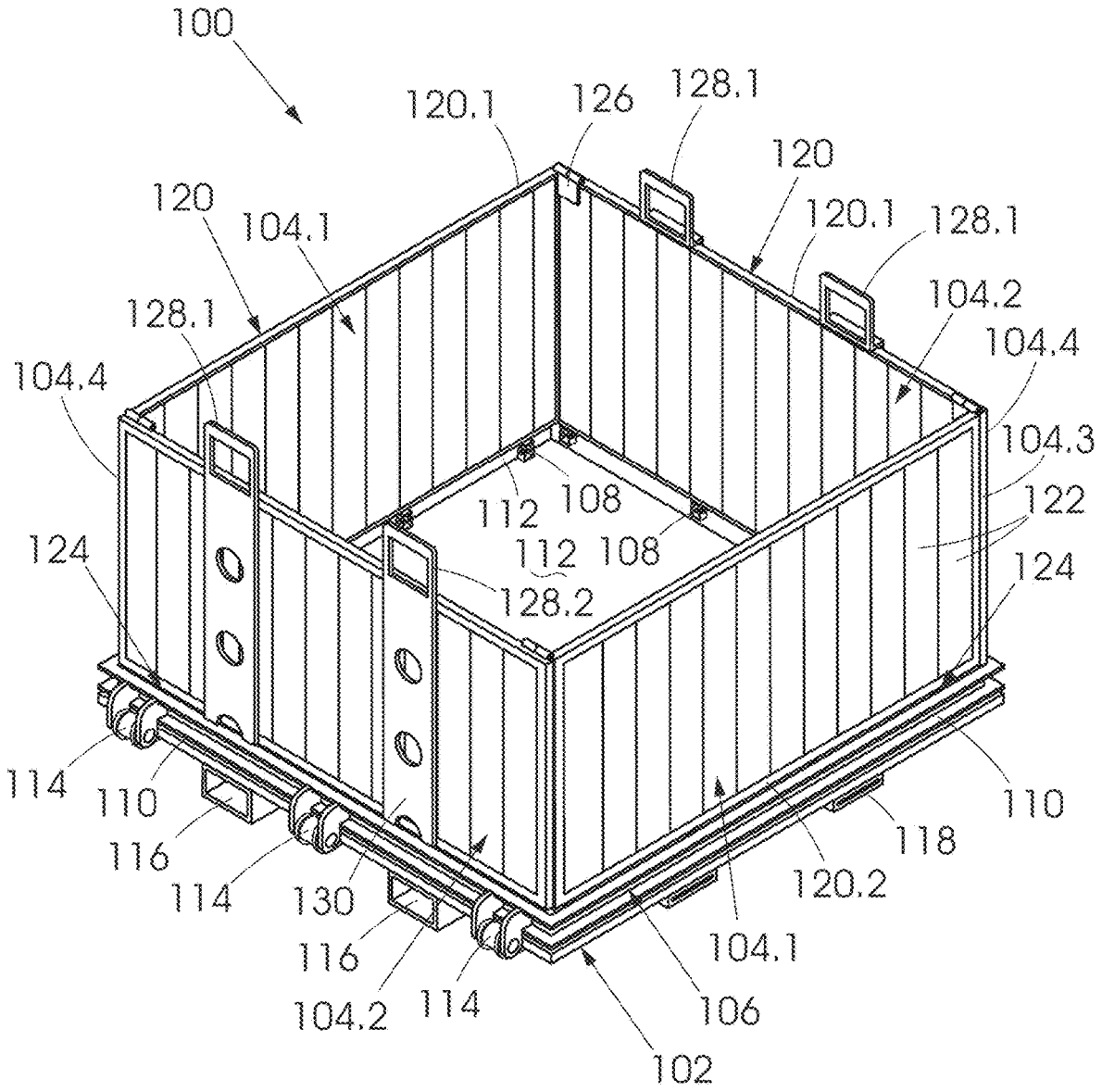
FIG. 1 shows a top perspective view of a transport container in an erect condition.
Figure 2:
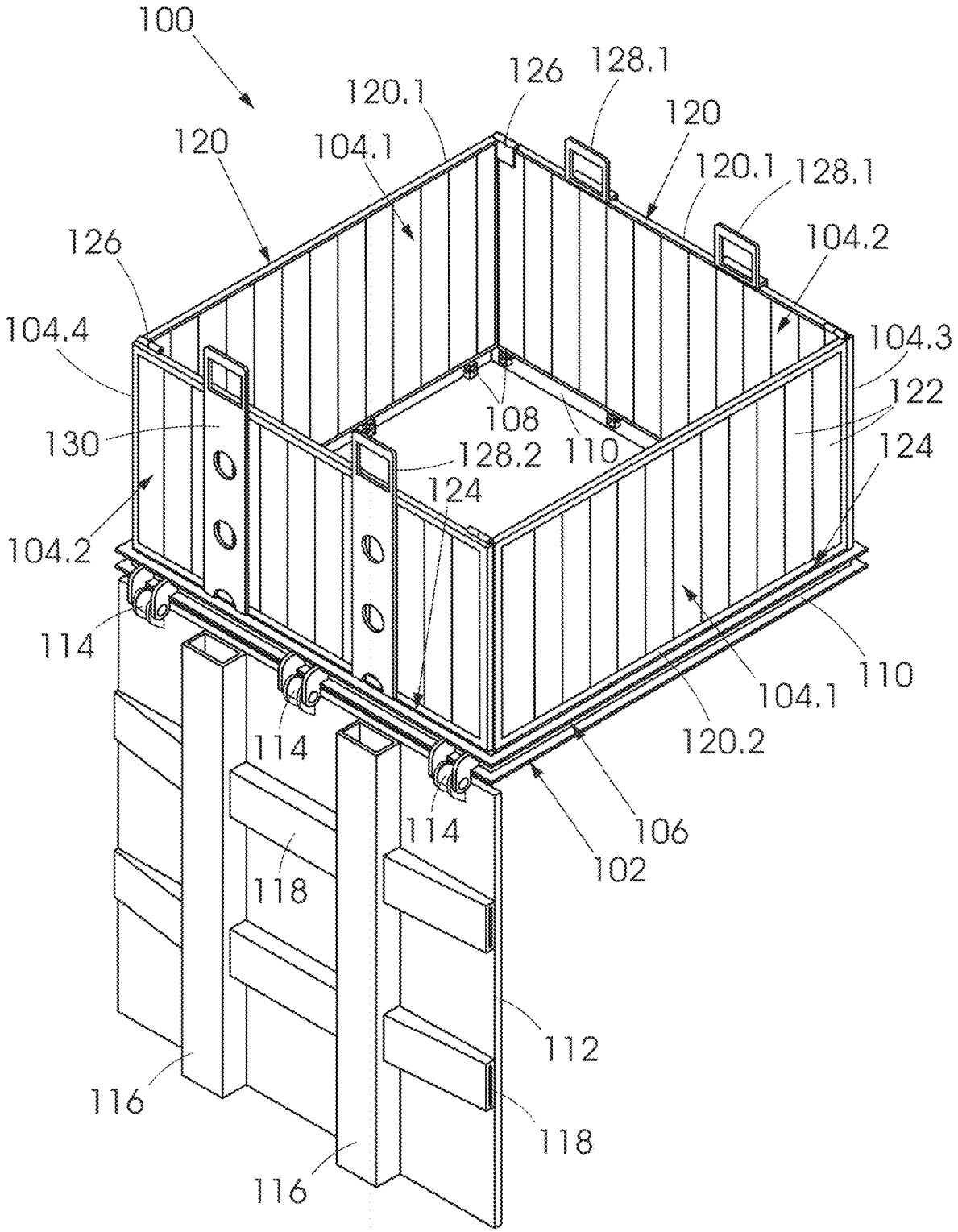
FIG. 2 shows the transport container with a floor hinged into an open, discharge position.
Figure 3:
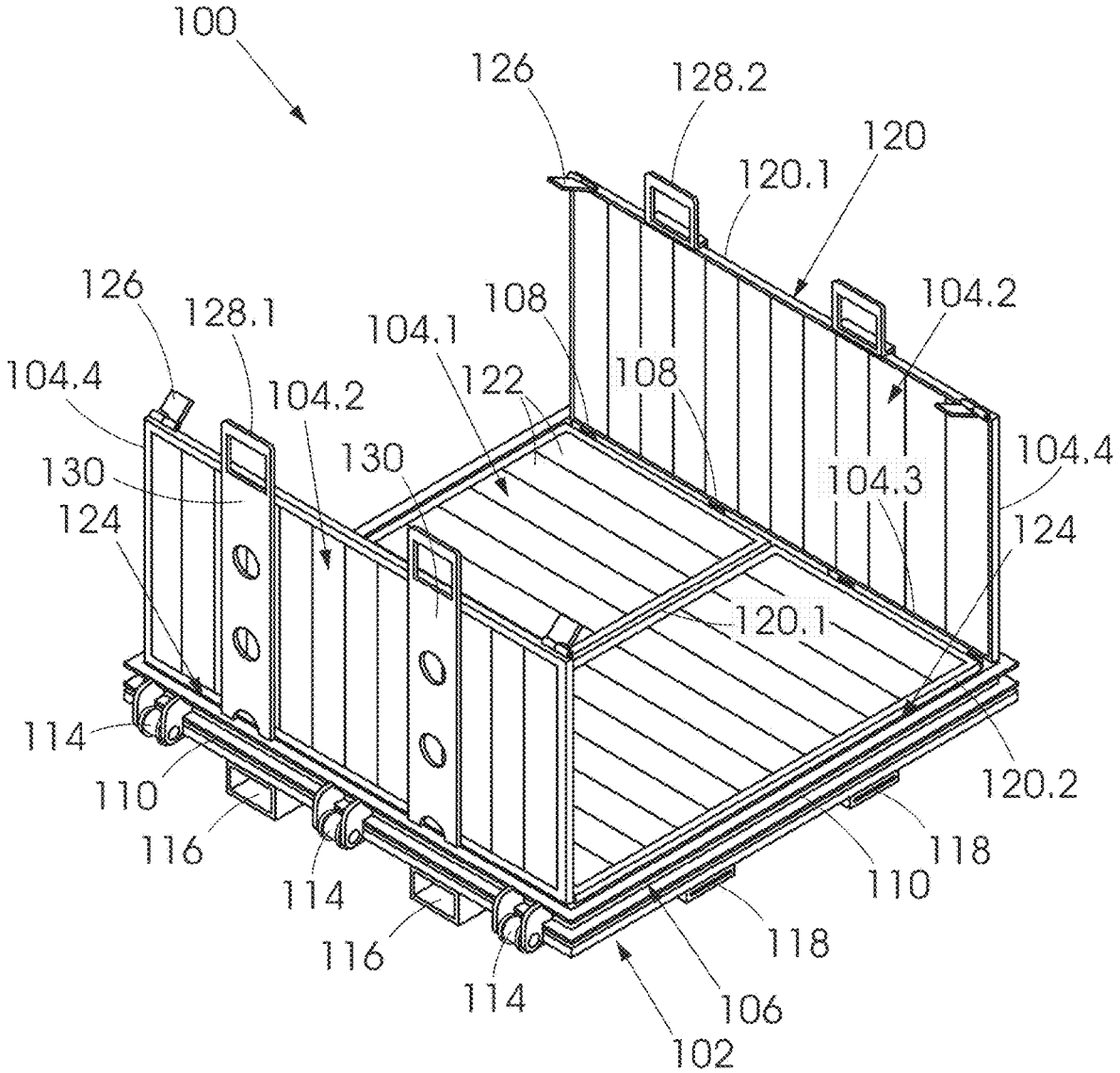
FIG. 3 shows the transport container with inner sidewalls hinged flat.
Figure 4:
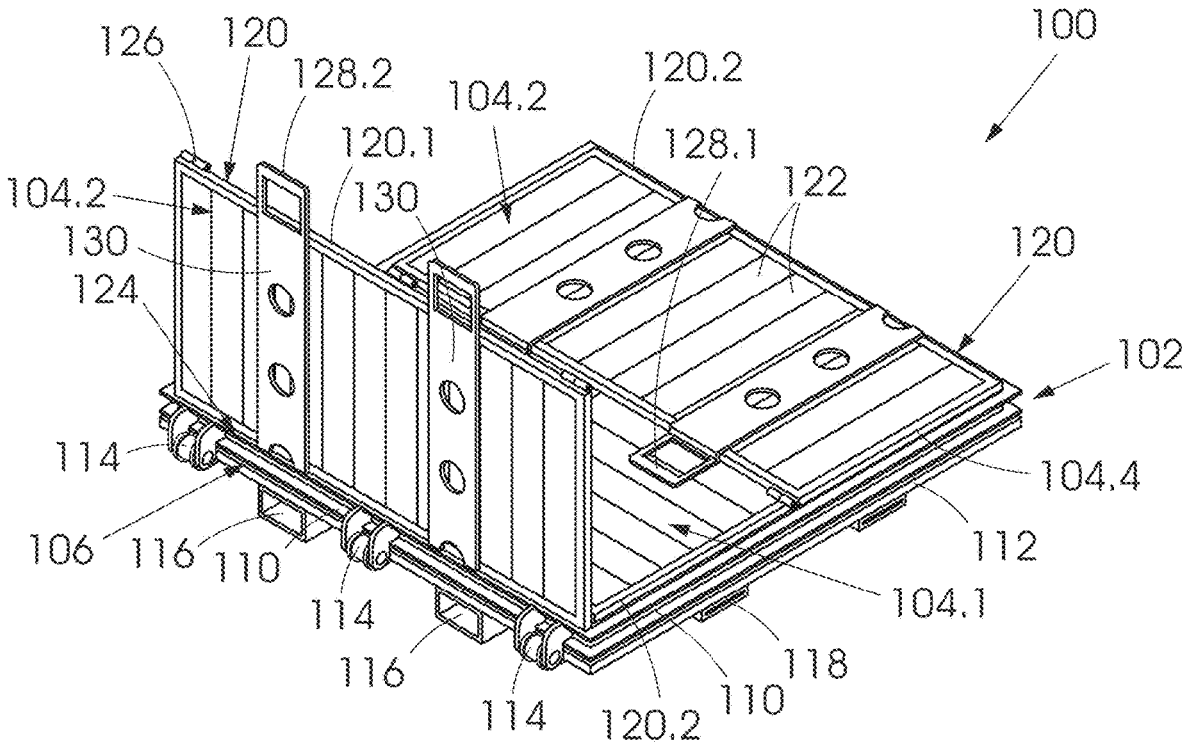
FIG. 4 shows the transport container in FIG. 3 with one outer sidewall hinged flat.
Figure 5:
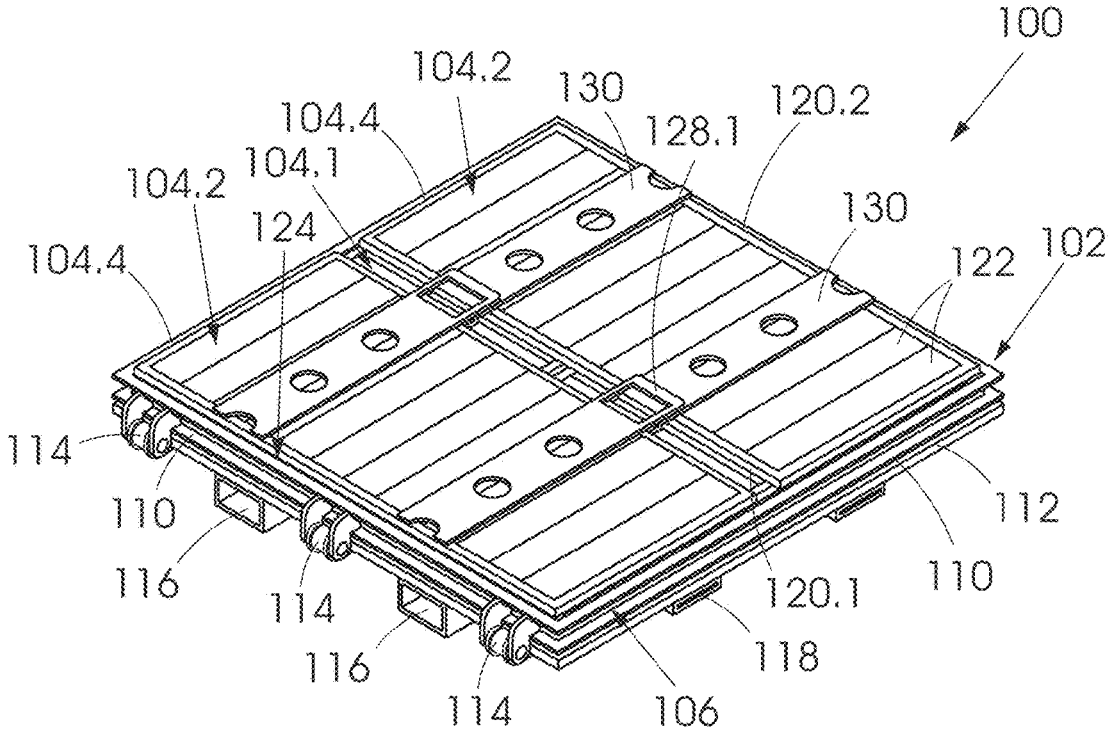
FIG. 5 shows the transport container in a folded flat condition.

Referring to the drawings, a container (100) for transport of bulk cargo is illustrated. The container (100) is suited for use on a flatbed loading surface (not shown). The loading surface may be that of a truck, trailer or rail wagon. A tautliner (or curtain-side) truck or trailer may be used.

The bulk cargo in this example will be an ore, such as chrome, and the containers will be loaded onto flatbed trailers. In this preferred embodiment, the bulk cargo is accordingly a mining industry product of particulate material nature. Alternative forms of bulk cargo to which use of the container is suited will however be appreciated.

More specifically, the flatbed trailer will be of the kind that is referred to as a super-link or inter-link. These trailers include a combination of a front trailer that is 6 meters in length and a rear trailer that is 12 meters in length.

The weight of the chrome (bulk cargo) is such that, in this example, between two and five of the illustrated containers can be used on the flatbed trailers to accommodate an acceptable load. Alternative configurations and arrangements may involve the use of some other plurality of containers on a flatbed trailer. The exact number that makes up the plurality of containers for use as a set to carry a particular load should not be considered a limitation.

The transport containers (100) are secured along the flatbed trailer and have a width suited for use with one container across the trailer and a length suited for use with three of the containers arranged along the flatbed trailer. In other examples and in the case of flatbed trucks, the number making up a plurality of transport containers in a set of containers that are used together to constitute a load may be varied.

Turning back to the drawings, the container (100) includes a substantially square base (102), which may also be some other variation of a suitable rectangular structure. Four sidewalls (104.1; 104.2) are hingedly secured to the base (102). The sidewalls (104.1; 104.2) are movable from an erect position into a folded, flat position. In the erect position, the container forms an open top box which conveniently receives a relevant portion of a load for a flatbed trailer (or truck).

The box structure of the erected container (100) preferably provides an open loading space between the four sidewalls (104.1; 104.2) absent any partition and/or reenforcing structures, as shown in the drawings. The folded condition allows for stacking of the container (100) when it is empty and not in use.

More specifically, the sidewalls (104.1; 104.2) are provided as two opposite pairs, with sidewalls of an inner pair (104.1) having side edges (104.3) located between sidewalls of the outer pair (104.2) when the container (100) is in the erect condition and when the inner pair (104.1) are moved towards and into a folded position.

A rectangular rigid metal frame (106) of the base (102) is secured to the sidewalls (104.1; 104.2) through wall hinge components (108) provided on an inner side of four connected frame members (110). The frame members (110) are provided as outwardly facing channels with inwardly disposed webs providing the inner side of the frame (106). Four wall hinge components (108) are provided for each sidewall (104.1; 104.2).

The base (102) includes a floor (112) located below the rectangular frame (110), which closes against the four frame members (110). Three floor hinge components (114) are provided on an outer side of one of four frame members (110).

The floor (112) configured as a hinged panel on the container (110) that extends across the frame (109) of the base (102). The floor (112) is provided by a sheet of suitably thick metal re-enforced by a pair of forklift sleeves (116) for lifting of the loaded container (100). The forklift sleeves (116) are provided by two spaced apart channels secured against an underside of the floor (112). The floor (112) includes two spaced apart cross-supports (118) providing gussets on either side of the forklift sleeves (116).

The sidewalls (104.1; 104.2) are constructed from a rectangular metal wall frame (120) supporting wooden planks (122). The adjacent planks (122) have tongue and groove overlapping formations. The wall frame (120) comprises four suitably sized lengths of angle iron. The planks (122) are secured to an inside flange of the wall frame (120) as shown in the drawings. The planks can be bolted to upper and lower members of the wall frame (120). The other flange of the angle iron profile in the wall frame (120) covers the outer edges of the sidewalls (104.1; 104.2) and provides for welding of the wall hinge components (108). Pine planks with a wall thickness of about 38 mm are used in this example.

The folding arrangement of the container (100) in this example provides for a first pair of inner sidewalls (104.1) to fold inwardly and be located beneath a second pair of outer sidewalls (104.2) which are folded over the first pair (104.1) to bring the container (100) into the folded condition. The folded arrangement is achieved by having hinge connections (108.1) of the inner sidewalls (104.1) that are spaced below hinge connections (108.2) of the outer sidewalls (104.2) on the rectangular frame (106).

The sidewalls of the inner pair (104.1) fold flat into a substantially co-planar condition and are sized so that their free ends are in juxtaposition. The sidewalls of the outer pair (104.2) also fold flat into a substantially co-planar condition above the sidewalls of the inner pair (104.1) and are sized so that free ends are in spaced apart relationship.

In this embodiment, the dimensions of the container (100) include the following:

The outer dimensions of the frame (106) will be about 2230 mm×2230 mm.

The inner pair of sidewalls (104.1) will be about 2145 mm (length)×960 mm (width/height).

The outer pair of sidewalls (104.2) will be about 2045 mm (length)×1000 mm (width/height).

To provide the box configuration, the sidewalls (104.1; 104.2) are folded or hinged outwardly against stops (124) located on the base (102). The stops are provided by shoulders (124) on an inner side of the rectangular frame (106) spaced above the wall hinge components (108). The shoulders (124) abut wall hinge components (108) of the sidewalls and/or portions of the sidewalls themselves. In addition, a square tube extension (not shown) may be welded along the frame members (110) that correspond to the outer sidewalls (104.2), which have wall hinge components (108) provided closer to a top edge of the frame (106). The square tube extension increases the size of the shoulder stop (124) provided by the frame (106). A short piece of square tube extension (not shown) will also preferably extend onto the frame members (110) that correspond to the inner sidewalls (104.1), to reinforce the structure and also extend the shoulder stops (124) of the inner sidewalls (104.1).

The outer sidewalls (104.2) are supported erect between the stops (124) and the inner sidewalls (104.1), which prevent the outer sidewalls (104.2) from moving on the wall hinge components (108.2). The sidewalls of the outer pair (104.2) include an arrangement of detents (126) that hold sidewalls of the inner pair (104.1) in an erect position and prevent the inner sidewalls (104.1) from moving on the wall hinge components (108.1). The detents in this embodiment are provided as hinged lugs (126) at free ends and adjacent side edges (104.4) of the sidewalls of the outer pair (104.2). The arrangement of sidewalls (104.1; 104.2), stops (124.1; 124.2) and detents (126) lock the container (100) in the box configuration.

The two outer sidewalls (104.2) are provided with forklift engaging formations (128.1; 128.2) at an upper end. The forklift engaging formations (128.1; 128.2) are formed as openings in the tops of elongate metal plates (130) that are fastened to top (120.1) and bottom (120.2) members of the wall-frames (120).

A first pair of forklift engaging formations (128.1) provided on one outer sidewall (104.2) to extend from an inner side and a second pair of forklift engaging formations (128.2) on the other outer sidewall (104.2) extend from an outer side. The first pair (128.1) are stepped inwardly at the top of the one outer sidewall (104.2) to achieve this feature. In the result, the first (128.1) and second (128.2) forklift engaging formations are provided to occupy an overlapping arrangement when the outer sidewalls (104.2) are in a folded position.

As an additional measure, the four sidewalls (104.2; 104.2) can be strapped together with webbing and cam-buckle fasteners (not shown), which may be wrapped around an outside of the container (100) for added strength. The sidewalls (104.2; 104.2) may have fastening formations (not shown) through which the webbing is threaded or to which hooks on the webbing may be engaged.

Additional fastening, locking or bracing means may be included on the container as required to maintain the box-form of the container when loaded, under use conditions.

In use, the container (100) is supported on the channels of the forklift sleeves (116) of the hinged floor (112) with the base (102) and sidewalls (104.2; 104.2) resting on the floor (112) in a closed condition. The container (100) can be moved with a forklift engaging the underside of the base (102) or floor (112) with its forks in the sleeves (116). In this manner a container (100) filled with particulate material will be lifted into position onto a flatbed and secured in place.

The containers (100) will also be offloaded in the same manner and located in a position where the contents are to be discharged. The forks of the forklift are then located in the forklift engaging formations (128.1; 128.2) of the outer pair of sidewalls (104.2). Lifting the container (100) in this manner allows the panel of the hinged floor (112) to pivot or hinge open and the load is discharged.

The container (100) will be set down in a manner that causes closing of the hinged floor (112). The floor panel (112) may be tethered to the base (102) with a chain so that when it swings open it is to a position that is limited and which results in closing when the container is lowered onto a surface again. The desired result can however be achieved by appropriate maneuvering and controlled lowering with the forklift.

The containers (100) will then be folded into the flat-pack condition. The sidewalls (104.1; 104.2) are demountable for stacking of empty containers (100) once the cargo has been delivered and offloaded. This can be done one at a time with each subsequent container (100) lowered onto another and then folded.

It is estimated that a single flatbed truck or trailer will be able to carry a large number of stacked folded containers that represent about 45 loads. This arrangement allows for 44 open flatbed trucks or trailers for every 45 that are trucked to a harbor or port. Calculations will vary based on the number of containers making up a truck/trailer load but this provides an indication of the logistical advantages presented by the invention.

Alternatively, folded containers can (for example) be strapped onto the top of a shipping container loaded onto a flatbed truck or trailer (where the resulting height is permissible). Other storage arrangements will be appreciated depending on the configuration of truck or trailer and whether there are rail options involved between the two destinations.

The arrangement of hinging or pivoting sidewalls may take any number of configurations that enable the flat-pack result. The forklift engaging formations and sleeves may also be varied. The panels of the floor may include means for locking in the closed condition.

In an alternative embodiment, the base will include two hingedly secured panels providing a floor of the container. The floor hinge components will preferably be arranged on opposite sides of the container. Each hinged panel will have a pair of aligned forklift sleeves. The sleeves in this variation may be provided by four inverted channels secured with a web against an underside of each panel. The opening line between the floor panels and the inverted channels extends across the middle of the base, between the second pair of sidewalls.

The transport container of the invention provides a structure that is easily loaded and off loaded and can discharge its particulate material contents with relative convenience. The container allows the use of any flat loading surface for transport of bulk cargo in discreet units determined by the size of the containers. The containers can be easily stacked in a compact configuration, when not in use. The erection of the sidewalls is also convenient, and the containers are quickly convertible to the open-box form.

The container of the invention can also be used for transport of bulk cargo on river/sea freight vessels. Trailers configured for abnormal application whereby the length of the trailer components could be longer than a super/inter-link due to a specific custom design could also be used to carry the transport containers.

Instead of the forklift engaging formations on the sidewalls, an arrangement of chains may be used to lift the container and open the floor for discharge of the load. The chains could be operated from a forklift, a crane, or a block and tackle, for example.

Also, variations of the container may include locking means to secure the floor closed against the base.

A person skilled in the art will appreciate that a number of additional variations may be made to the features of the embodiment described without departing from the scope of the current invention.

The invention claimed is:

1. A transport container for bulk cargo comprising:

a container having a rectangular base;

four sidewalls hingedly connected to the base;

the sidewalls being movable:

from an erect condition, providing an open box structure with a loading space between the four sidewalls;

into a folded flat condition;

the base including a floor comprising a discharge panel hingedly connected to the base;

the base including a rigid rectangular metal frame with four connected frame members that are secured to the sidewalls through wall hinge components and the floor provided as a single hinged discharge panel that extends across the base;

the floor including a pair of forklift sleeves for lifting of a loaded container; and the container having forklift engaging formations provided on two oppositely arranged sidewalls for opening of the discharge panel on lifting of the container;

wherein the wall hinge components are provided on an inner side of the four connected frame members;

the sidewalls are provided as two opposite pairs, with sidewalls of an inner pair having side edges located between sidewalls of an outer pair when the container is in the erect condition and in which the sidewalls of the inner pair are located below the sidewalls of outer pair when the container is in the folded flat condition;

the sidewalls of the inner pair have first wall hinge components that are spaced below second wall hinge components for the sidewalls of the outer pair on the rectangular frame; and the floor is located below the rectangular frame and closes against the four frame members with floor hinge components provided on an outer side of one of the four connected frame members.

2. The transport container as claimed in claim 1, wherein the sidewalls of the inner pair fold flat into a substantially co-planar condition and the sidewalls of the outer pair fold flat into a substantially co-planar condition above the sidewalls of the inner pair.

3. The transport container as claimed in claim 2, wherein the forklift engaging formations are provided on the sidewalls of the outer pair.

4. The transport container as claimed in claim 3, wherein first forklift engaging formations extend from an inner side of one outer sidewall and second forklift engaging formations extend from an outer side of the other outer sidewall, an arrangement of the first and second forklift engaging formations providing an overlapping arrangement when in a folded position.

5. The transport container as claimed in claim 1, wherein the sidewalls locate against stops, when in an erect position, provided on the base.

6. The transport container as claimed in claim 5, wherein the stops are provided by shoulders on the rectangular frame spaced above the wall hinge components.

7. The transport container as claimed in claim 6, wherein the sidewalls of the outer pair have detents that hold the sidewalls of the inner pair in an erect position.

8. The transport container as claimed in claim 2, wherein the detents are provided as hinged lugs at free ends and adjacent the side edges of the sidewalls of the outer pair.

9. The transport container as claimed in claim 1, wherein the forklift engaging formations of the container are provided at an upper end of the two oppositely arranged sidewalls.

10. The transport container as claimed in claim 1, wherein the pair of forklift sleeves are provided by two spaced apart channels secured against an underside of the floor.

11. The transport container as claimed in claim 1, wherein the floor is provided by a metal sheet re-enforced by the pair of forklift sleeves.

12. The transport container as claimed in claim 1, wherein the sidewalls are constructed from a metal wall frame supporting wooden planks.

13. The transport container as claimed in claim 1, wherein the bulk cargo is particulate material and a mining industry product.

* * * * *